US009933142B1

(12) United States Patent
Holland

(10) Patent No.: US 9,933,142 B1
(45) Date of Patent: Apr. 3, 2018

(54) LED STRIP LIGHTING

(71) Applicant: i-Lighting, LLC, North East, MD (US)

(72) Inventor: Scott D. Holland, North East, MD (US)

( * ) Notice: Subject to any disclaimer, the term of this patent is extended or adjusted under 35 U.S.C. 154(b) by 264 days.

(21) Appl. No.: 14/497,066

(22) Filed: Sep. 25, 2014

Related U.S. Application Data

(60) Provisional application No. 61/882,606, filed on Sep. 25, 2013.

(51) Int. Cl.
*F21V 21/005* (2006.01)
*F21S 4/00* (2016.01)
*F21V 23/00* (2015.01)

(52) U.S. Cl.
CPC ..... *F21V 21/005* (2013.01); *F21S 4/008* (2013.01); *F21V 23/005* (2013.01)

(58) Field of Classification Search
CPC ..... F21V 23/005; F21S 4/008
USPC ..... 362/249.06
See application file for complete search history.

(56) References Cited

U.S. PATENT DOCUMENTS

2004/0252501 A1* 12/2004 Moriyama ..... F21V 19/0025 362/238
2009/0296382 A1* 12/2009 Maier ..... F21V 15/01 362/218
2010/0008090 A1* 1/2010 Li ..... F21V 17/007 362/249.03
2010/0321941 A1* 12/2010 Sakai ..... H01L 33/486 362/296.01
2011/0116271 A1* 5/2011 Ide ..... H01L 33/486 362/294
2012/0162990 A1* 6/2012 Crandell ..... B32B 33/00 362/249.04
2013/0077295 A1* 3/2013 Hayashi ..... F21V 29/00 362/217.05
2013/0188357 A1* 7/2013 Sloan ..... G09F 13/0404 362/249.01
2014/0247595 A1* 9/2014 Lind ..... G09F 13/0404 362/249.04

* cited by examiner

*Primary Examiner* — Laura Tso
(74) *Attorney, Agent, or Firm* — Ramberg IP, LLC; Jeffrey R. Ramberg

(57) ABSTRACT

An LED strip featuring perforations between adjacent LEDs that enable one to break the LED strip at the perforation using mere hand pressure. In another aspect of the invention, not only does the LED strip feature "polarity-correcting" circuitry, but also that each LED proper contains such a polarity-correcting circuit, so that regardless of where the lighting strip is broken, the broken-off portion still features polarity-correcting qualities. In yet another aspect of the invention, the LED strip can be broken at any perforation, and the two broken surfaces will each feature electrical contacts or connectors that can be removably (temporarily) attached to a pair of electrical conductors (e.g., wires), thereby permitting each of the remaining and broken-off sections of the original LED strip to function as a light source, as well as to be able to connect to both "upstream" electrical sources and "downstream" electrical loads such as additional LED strips. Thus, such LED strips may then be manufactured and sold in standard lengths, and the customer or other end-user can easily adjust the LED strip to his or her particular application by breaking off the unwanted section at the desired location.

14 Claims, 5 Drawing Sheets

LED STRIP LIGHTING

CROSS-REFERENCE TO RELATED APPLICATIONS

This patent document claims the benefit of U.S. Provisional Patent Application No. 61/882,606, filed on Sep. 25, 2013 in the name of Scott D. Holland. The drawings of this prior provisional patent application are herein expressly incorporated by reference.

STATEMENT REGARDING FEDERALLY SPONSORED RESEARCH

None.

BACKGROUND OF THE INVENTION

1. Field of the Invention

The present invention relates to artificial, i.e., non-natural, lighting systems, and more specifically to low voltage DC LED lighting systems.

2. Discussion of Related Art

Light-emitting diodes, or "LEDs", are surging in popularity for lighting applications of all sorts. Although they have long held numerous technical advantages over more traditional types of artificial lighting such as incandescent bulbs, fluorescent lighting or halogen lighting, they were extremely expensive, and thus not widely used. Now that they are cost competitive, their technical superiority shines through. For example, LEDs are being used extensively in motor vehicles, and not just for illuminating instrument panels, but also as powerful light sources such as headlights. Similarly, LEDs are being used as street lights.

LEDs are low current devices. Thus, a large number of LED lights can be powered without drawing excessive amounts of electrical current. Since LEDs are driven by low voltages, the total electrical power consumed is very small compared to more conventional lighting sources.

Many American homes have outdoor decks or patios, and Americans enjoy them very much. Among other reasons, they enjoy the outdoors without having to venture far from home. In recent years, it has become possible and desirable to provide lighting of the deck or patio area so that people can enjoy their decks and patios after sunset.

Another popular feature in many American homes is the lighting of horizontal surfaces in the kitchen such as countertops, tables or "islands" from lights mounted above, such as from underneath kitchen cabinets. Such lights traditionally have been incandescent or fluorescent. With the advent of LEDs, and especially with the advent of thin, elongated strips featuring LEDs such as surface-mounted LEDs positioned every inch or so, it is now possible to use LED lights for this application. However, the homeowner or installer up to now has had to carefully measure the length of light strip that he needs, and place a custom order for this length, or has had to try to cut a stock length of LED lighting strip material to his desired length.

LEDs are low voltage devices, and they are also direct current (DC) devices. Thus, lighting systems that are designed as low voltage AC systems, require rectification before the current is supplied to the LED. Some low voltage AC systems have rectifier circuitry at each LED lamp or bulb. Power supplies that supply the current in DC form thus do not require componentry for rectification. In these systems, however, if the DC current is of the wrong (opposite) polarity than what the LED wants and requires, the LED will not function. In a string of LED lights, this problem can manifest itself in none of the LED lamps being lit, or only every other LED lamp being lit. One solution is to provide the LED lights with electrical connectors that are clearly marked to ensure the correct polarity. Unfortunately, it may be possible for the user or installer to plug the connectors together incorrectly.

The instant invention addresses and solves these problems.

SUMMARY OF THE INVENTION

In accordance with a first aspect of the present invention, an LED strip featuring perforations between adjacent LEDs enables one to break the LED strip at the perforation using mere hand pressure, thereby permitting the homeowner or installer a simple way to customize the length of the LED lighting strip to the desired length. In another aspect of the invention, not only does the LED strip feature "polarity-correcting" circuitry, but also that each LED contains such a polarity-correcting circuit, so that regardless of where the lighting strip is broken, the broken-off portion still features polarity-correcting qualities. In yet another aspect of the invention, the LED strip can be broken at any perforation, and the two broken surfaces will each feature electrical contacts or connectors that can be removably (temporarily) attached to a pair of electrical conductors (e.g., wires), thereby permitting each of the remaining and broken-off sections of the original LED strip to function as a light source, as well as to be able to connect to both "upstream" electrical sources and "downstream" electrical loads such as additional LED strips.

DETAILED DESCRIPTION OF THE INVENTION

Figure 1:
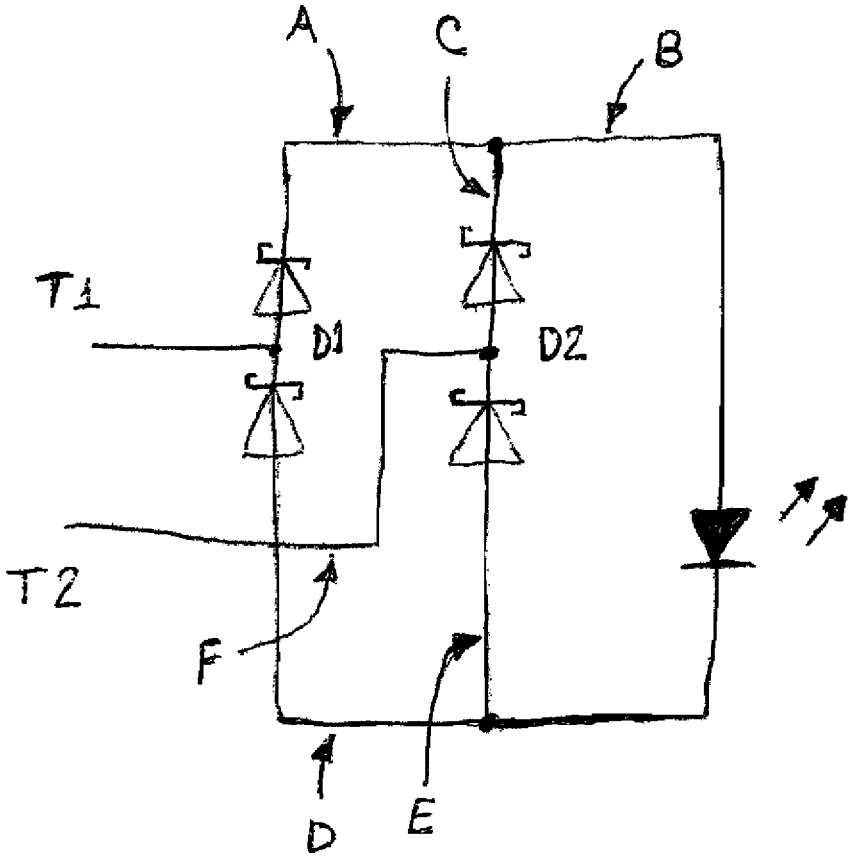
FIG. 1 illustrates one embodiment of an electrical schematic diagram for automatically correcting the polarity of a DC voltage input for a LED.

The present invention contains a number of aspects or features, and is described with reference to FIGS. 1-5. In accordance with a first aspect of the present invention, what is provided is a LED strip featuring perforations 31 between adjacent LEDs 33, 35 that enable one to break the LED strip at the perforation using mere hand pressure. Thus, such LED strips may then be manufactured and sold in standard lengths, and the customer or other end-user can easily adjust the LED strip to his or her particular application by breaking off the unwanted section at the desired location.

LEDs are polarity-sensitive devices. In another aspect of the present invention, the LED strip contains "polarity correcting" circuitry so that if the LED strip is supplied with DC voltage, the lamps will light regardless of the polarity of the applied voltage. Not only does the present LED lighting strip feature polarity-correcting circuitry so that the LEDs will light regardless of the polarity of electricity supplied to the lighting strip, but each LED contains such a polarity-correcting circuit, so that regardless of where the lighting strip is broken, the broken-off portion still features polarity-correcting qualities. Thus, the LED lighting strip may be thought of as a supporting substrate 37 onto which are mounted or attached the LED lamps, plus the electrical circuitry such as conductor paths, terminals 43, 45 and polarity-correcting circuits.

One end of a LED strip of the present invention features a pair of electrical contacts arranged to make a removable or temporary electrical connection to a pair of electrical conductors, e.g., wires, that connect to a source of electrical power, e.g., a power supply or an extension cord or segment, sometimes referred to as a "jumper set". Typically, the pair of electrical conductors feature an electrical connector or "plug" 51 arranged to make a good "robust" highly reliable electrical connection with the electrical contacts on the LED strip. The connections may feature a latching mechanism. This end will be referred to as the "head" of the LED strip. The other end, being the "tail", features a pair of electrical contacts arranged to make removable or temporary electrical connection to a second LED strip or to a second extension or jumper set, so that the other end of the jumper set may plug into the second LED strip. Similarly, the second LED strip also features a pair of electrical contacts at its tail end so that, if desired, electrical power may be supplied to a third LED strip, and so on. Please note that subsequent LED strips are not required for the electrical circuit to be complete. The electrical connectors that plug into the head and tail ends, respectively, of the LED strip may be the same, or of a different design.

Moreover, and in yet another aspect of the present invention, the perforations are designed and engineered such that each broken surface features electrical contacts arranged to make a removable (or temporary) electrical connection to a power supply or to a jumper set. Thus, even if one has to shorten a stock length of LED strip, the remaining portion can still be electrically connected to downstream LED strips, and the broken-off portion can also be used for lighting and can be electrically connected to an upstream source of electrical power, and to a downstream (different) LED strip.

The LED lighting strip may be used anywhere where a linear array of closely-spaced lights are desired. One such application is to illuminate a kitchen countertop by mounting such a linear array of LED lights underneath a kitchen cabinet. In this particular application, and perhaps in others as well, the LED lighting strip is mounted inside of an elongated tube 59. The tube not only is designed to accept and accommodate the LED lighting strip, but it is also designed such that the LED strip cannot rotate about its longitudinal axis. One side of the tube is arranged to be attachable to a surface such as underneath the kitchen cabinet, for example, by means of an integral self-adhesive strip 49. The side of the tube opposite the attachable side is transparent or translucent to permit illumination when the LEDs are energized.

The tube for mounting the LED strip comes in various stock sizes, both length and diameter. The LED strips come in stock widths of at least 5 mm and 10 mm; thus, the tubes have at least such an inside diameter to accommodate these widths. The LEDs may be of the surface mount variety, and may vary in spacing, for example, from one LED every 10 cm to one every 5 mm. A more typical spacing, however, may be on the order of one LED every 1 cm.

In terms of color, nowadays LEDs can be designed to produce the full range of colors of the visible spectrum.

Figure 2:
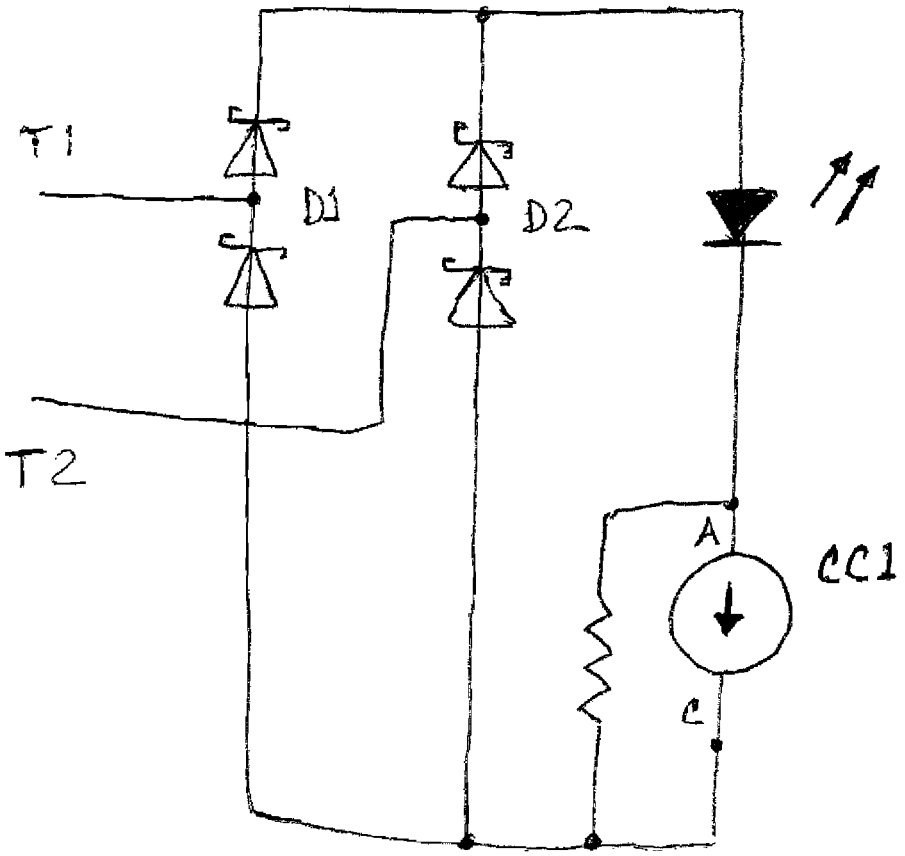
FIG. 2 illustrates a schematic diagram similar to that of FIG. 1, but including a constant current LED driver.
Figure 3:
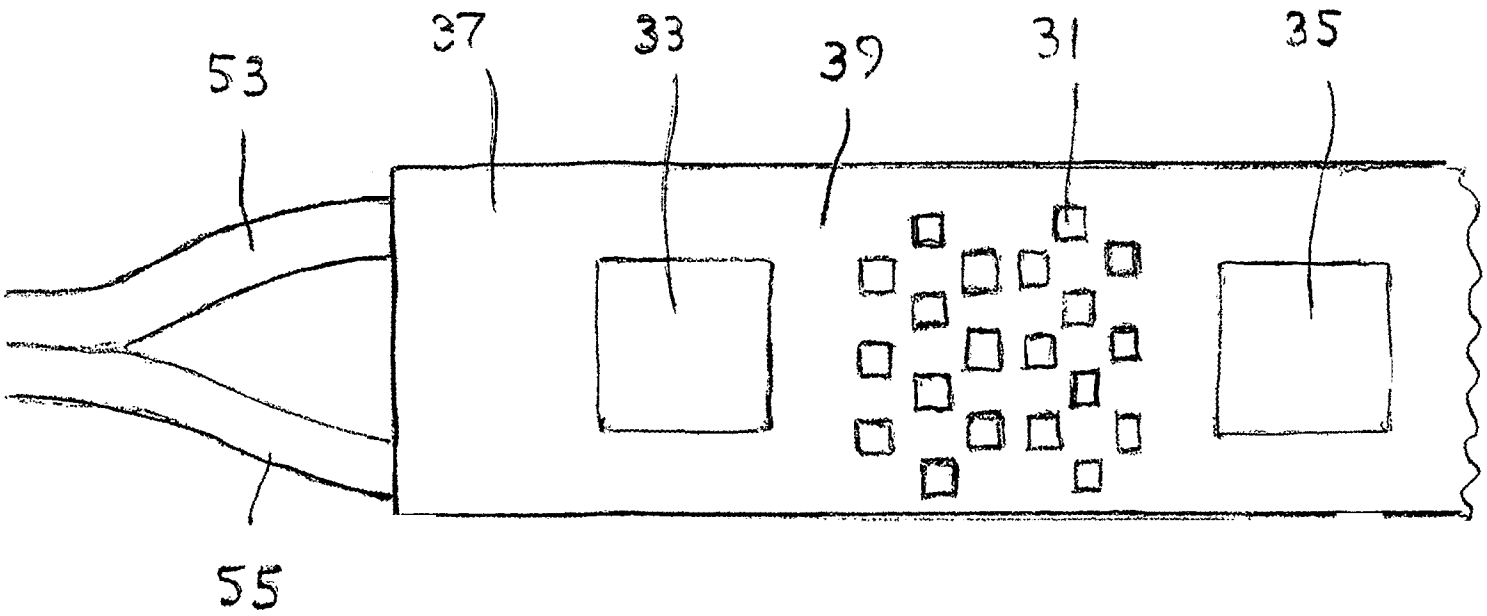
FIG. 3 is a top view of a substrate.
Figure 4:
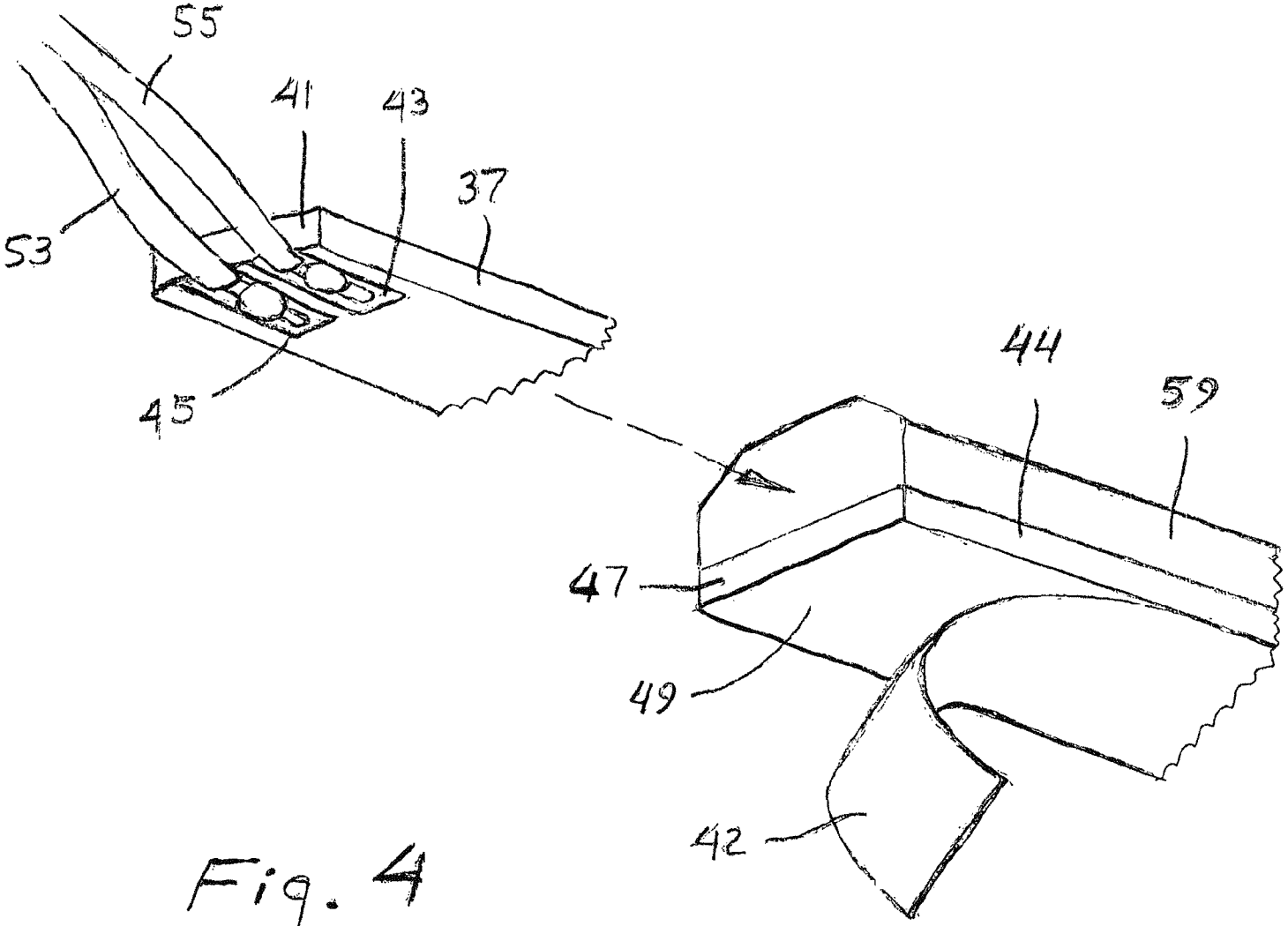
FIG. 4 is an isometric view of an LED lighting strip about to be mounted inside of an elongated tube.
Figure 5:
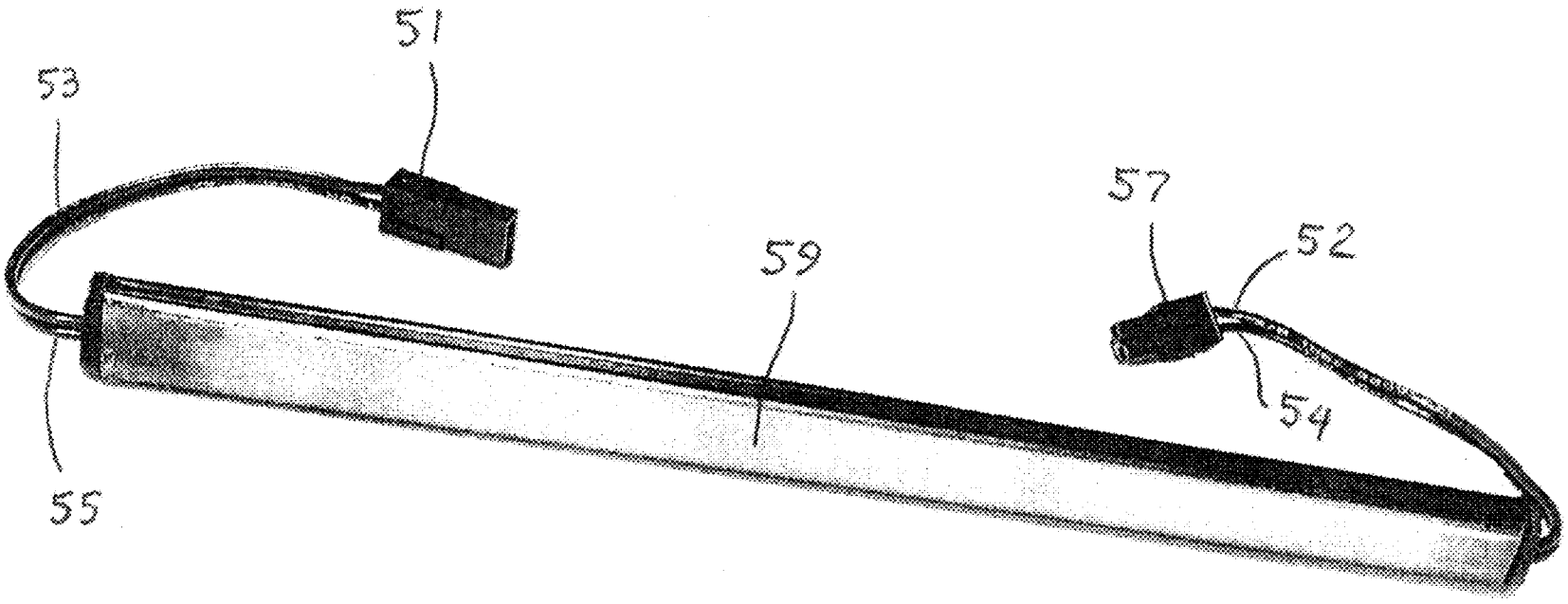
FIG. 5 is a perspective view of an assembled LED lighting strip.

Referring now particularly to FIGS. 1 and 2, where like numbers denote like components, FIG. 1 is a schematic diagram of the basic electrical circuit for automatically supplying DC voltage of the correct or proper polarity to a LED. The circuit does this by reversing or inverting the DC voltage supplied to the LED if it is of the wrong polarity for the LED to function. In particular, one can see that the pair of diodes D1 and D2 such as Schottky diodes will only allow the correct polarity voltage to pass on to the LED. Specifically, D1 and D2 are arranged in a parallel electrical circuit, and are fed with the opposite polarity of the supplied DC voltage. Thus, one of D1 and D2 will be fed the correct polarity, and one of D1 and D2 will be fed the incorrect polarity. If D1 is supplied with the correct polarity from terminal T1, then electrical current is allowed to pass to points A and B, but is blocked from traveling to point C. The current thus passes through the LED, is blocked from passing to point D, and instead passes through points E and F and out through terminal T2.

Conversely, If D1 is supplied with the incorrect polarity from terminal T1, then electrical current is allowed to pass through points F, C and B from terminal T2, but is blocked from traveling to point A, again by D1. The current thus passes through the LED, is blocked from passing through point E by D2, and instead passes through point D and out through terminal T1.

FIG. 2 shows another embodiment of the polarity-correcting circuit of the invention. Here, constant current LED driver CC1 has been added to help smooth out current fluctuations. Thus, one can see that this circuit could be used to rectify alternating current. Thus, the voltages supplied to terminals T1 and T2 is not limited to direct current.

Installation Instructions

The following illustrates how to install LED strips of the present invention in an under-kitchen-cabinet environment. No protective transparent/translucent tubing is present in this embodiment.

Install the power supply by plugging it into the head of the first LED light strip.

Locate where the appropriate length LED light strips will be mounted.

Remove the backing 42 off the double-sided tape 44 and adhere the light strip to the cabinet.

Use the extension cables to bridge gaps between adjacent LED light strips by plugging the extensions into the LED light strip.

Fasten the extension cables to the cabinet using self-adhesive clips.

Continue to mount the light strips and connecting the extension cables.

For the embodiment featuring a LED lighting strip pre-mounted in its transparent or translucent, tube the instructions above are essentially the same, except that the double-sided tape is located on the tube instead of on the LED strip.

INDUSTRIAL APPLICABILITY

The instant invention should find immediate application wherever a linear array of closely-spaced LEDs are to be installed on a more-or-less permanent basis. For example, the embodiments of the present invention should find utility in the under-the-kitchen cabinet mounting application. Other similar applications will readily come to mind, such as under the lip or overhang on the step of a staircase, underneath any kind of ledge such as the eaves of a house, and under the railings of a deck or fence.

One of ordinary skill in the art will readily appreciate the advantages flowing from the instant invention, among others, that LED strip lighting manufacturers do not have to manufacture a group or family of strips of different lengths. They can simply manufacture a stock or standard design, and the end-user can readily and easily adjust the overall length as desired without requiring specialized tools, or any tools at all other than his or her hands.

An artisan of ordinary skill will appreciate that various modifications may be made to the invention herein described without departing from the scope or spirit of the invention as defined in the appended claims.

What is claimed is:

1. An LED strip comprising a plurality of LEDs mounted in a row on a substrate(37), said substrate comprising (i) perforations (31) between adjacent LEDs (33, 35), and (ii) a circuit board (39), and further wherein said circuit board comprises polarity-correcting circuitry.

2. The LED strip of claim 1, wherein each LED has its own polarity-correcting circuit.

3. The LED strip of claim 1, wherein a head end (41) of said substrate (37) comprises at least two electrical terminals (43, 45) arranged to make electrical contact with a first detachable plug (51) that is electrically connected to at least two electrical conductors (53, 55).

4. The LED strip of claim 1, wherein a tail end of said substrate comprises at least two electrical terminals arranged to make electrical contact with a second detachable plug (57) that is electrically connected to at least two electrical conductors (52, 54).

5. The LED strip of claim 4, wherein the second detachable plug has the same geometry as the first detachable plug.

6. The LED strip of claim 3, wherein breaking said substrate at a perforation exposes at least two new electrical terminals on said remaining substrate and at least two new electrical terminals on said broken-off substrate, with each of said new set of electrical terminals arranged to make electrical contact with at least one of said first and second detachable plugs.

7. The LED strip of claim 1, wherein said substrate is elongated and has a longitudinal axis.

8. The LED strip of claim 7, further comprising a tube (59) arranged to accept said LED strip.

9. The LED strip of claim 8, wherein said tube prevents said substrate from rotating about its longitudinal axis.

10. The LED strip of claim 8, wherein at least a portion of said tube adjacent said LEDs is transparent or translucent.

11. The LED strip of claim 8, wherein said tube further comprises a means for attaching (47) said tube to a mounting surface.

12. The LED strip of claim 11, wherein said means comprises an adhesive (49).

13. The LED strip of claim 12, wherein said adhesive is in the form of a strip, and further comprises a removable layer (42).

14. The LED strip of claim 11, wherein said means comprises a double-sided tape (44).

* * * * *